United States Patent [19]

Mayer et al.

[11] Patent Number: 4,828,048

[45] Date of Patent: May 9, 1989

[54] HYDRAULIC PERCUSSION TOOL

[76] Inventors: James R. Mayer, 7558 S. Rosemary Circle, Englewood, Colo. 80112; William N. Patterson, 7244 S. Garfield St., Littleton, Colo. 80122

[21] Appl. No.: 928,967

[22] Filed: Nov. 10, 1986

[51] Int. Cl.[4] ..... B23B 45/16

[52] U.S. Cl. ..... 173/134; 91/269

[58] Field of Search ..... 173/116, 119, 134, 120; 91/50, 51, 269

[56] References Cited

U.S. PATENT DOCUMENTS

| | | | |
|---|---|---|---|
| 3,903,972 | 9/1975 | Bouyoucos et al. | 173/134 |
| 4,044,844 | 8/1977 | Harris et al. | 91/50 |
| 4,150,603 | 4/1979 | Eberzinston et al. | 91/50 |
| 4,474,248 | 10/1984 | Musso | 173/134 |
| 4,646,854 | 3/1987 | Arndt et al. | 173/134 |

*Primary Examiner*—Frank T. Yost
*Assistant Examiner*—Willmon Fridie Jr.
*Attorney, Agent, or Firm*—Michael E. Martin

[57] ABSTRACT

A hydraulic in-the-hole type percussion tool including an elongated piston-hammer which is disposed for delivering percussion blows to an impact receiving bit or shank member and is adapted to reset an elongated tubular sleeve type distributing valve disposed in the tool cylinder rearwardly of the piston-hammer. The distributing valve is moved in one direction by the piston-hammer and is urged in the opposite direction by pressure fluid which is transferred to a chamber to act on a pressure surface of the distributing valve when the piston-hammer uncovers a fluid transfer port. An in-line hydraulic accumulator is disposed between the percussion mechanism and a source of working fluid and includes an annular piston forming an accumulator chamber and biased by a series of conical washer type springs. The tool is adapted to use high pressure water or drilling mud as the working fluid and which is conducted to and from opposed expansible chambers formed in an inner cylinder member. Inner and outer barrel type cylinder members are provided to define passages for conducting working fluid to the opposed expansible chambers and to conduct spent working fluid from one of the expansible chambers to a passage in the impact receiving member.

18 Claims, 4 Drawing Sheets

HYDRAULIC PERCUSSION TOOL

BACKGROUND OF THE INVENTION

1. Field of the Invention

The present invention pertains to an in-the-hole hydraulically actuated percussion tool particularly adapted for drilling relatively small diameter blastholes and for use in subterranean well operations.

2. Background

There have been several developments in the design of reciprocating piston-hammer type percussion tools wherein the energy output of the tool has been improved by utilizing hydraulic fluids as the working pressure fluid in order to provide for higher effective working pressures of the fluid and to increase the rate of energy output of the tool. U.S. Pat. Nos. 3,903,972; 3,896,889; and 3,991,655 to J. V. Bouyoucos describe examples of one type of hydraulic impact tool wherein a reciprocating piston-hammer actuates a sleeve type fluid distributing valve in both directions of hammer movement. U.S. Pat. No. 4,474,248 to Musso also describes a hydraulic impact tool wherein the piston-hammer is reciprocated through a working stroke cycle by actuation of a sleeve type fluid distributing valve which is moved in opposite directions by pressure fluid forces. Still further examples of hydraulic impact tools are described in U.S. Pat. Nos. 4,109,734 and 4,165,788 to Roger Montabert.

In the further development of hydraulic impact or percussion type tools certain improvements have been sought, particularly giving consideration to minimizing the overall outside diameter of the tool for certain applications which require a relatively slender in-the-hole tool or drill. It is, for example, desirable to avoid an arrangement where the fluid distributing valve encircles the piston-hammer while still providing for low pressure loss of the working fluid during the valving action. Other considerations include the location and type of pressure fluid accumulator which can be effectively utilized without increasing the overall tool diameter. Still further considerations include the provision of a hydraulic percussion impact tool or rock drill which can utilize a working fluid which is discharged into the borehole to serve as a cuttings evacuation fluid and dust suppressant. The use of water and fluids known as drilling muds are desirable to use in certain applications and tools using such fluids also enjoy the advantage that the construction of the tool may be such that it does not require fluid return passages nor are fluid return conduits required to be connected to the tool.

With the above objectives in mind and including other desired features in hydraulic percussion tools for drilling relatively small diameter holes the present invention has been developed and has met the criteria mentioned herein as well as providing for other unique advantages.

SUMMARY OF THE INVENTION

The present invention provides an improved hydraulically actuated impact or percussion tool of the type wherein a reciprocating piston-hammer is actuated by valving hydraulic fluid through a tubular or sleeve type fluid distributing valve. In accordance with one aspect of the present invention a hydraulic percussion tool is provided wherein the fluid distributing valve is arranged rearwardly of the piston-hammer with respect to the hammer anvil or impact receiving member while minimizing the pressure fluid loss during flow of fluid through the flow passages leading to the piston-hammer working chambers.

In accordance with another aspect of the present invention a hydraulically actuated percussion tool is provided wherein the arrangement of the piston-hammer, a sleeve type fluid distributing valve and fluid passageways through the tool housing are such as to provide for minimum pressure losses and advantageously provide for utilizing the working fluid as a drill cuttings flushing fluid. The invention further provides for an arrangement of a pressure fluid accumulator which is disposed in-line with the drill housing between a source of pressure fluid and an expansible chamber which is alternately placed in communication with working fluid at high pressure and then exhausts working fluid for discharge from the tool.

The particular arrangement of features mentioned above are advantageously combined in a percussion tool which is housed entirely within an elongated cylindrical tubular housing of relatively small diameter wherein the working mechanism of the tool is entirely within the hole being formed once a sufficient length of hole has been drilled to accommodate the tool structure. This arrangement is particularly advantageous for use of an impact or percussion tool in accordance with this invention in underground blast-hole drilling operations for tunneling or mining applications and for certain cleanout or workover operations in subterranean wells.

The present invention still further provides a hydraulically actuated percussion tool having a reciprocating piston-hammer which is actuated by a working fluid such as water or so-called drilling mud which may be exhausted from the tool working chambers to a forward or bit portion of the tool for use as a drill cuttings flushing liquid.

The above described advantages and desirable features of the present invention as well as other superior aspects thereof will be further appreciated by those skilled in the art upon reading the detailed description which follows in conjunction with the drawing.

DESCRIPTION OF A PREFERRED EMBODIMENT

Figure 1A:
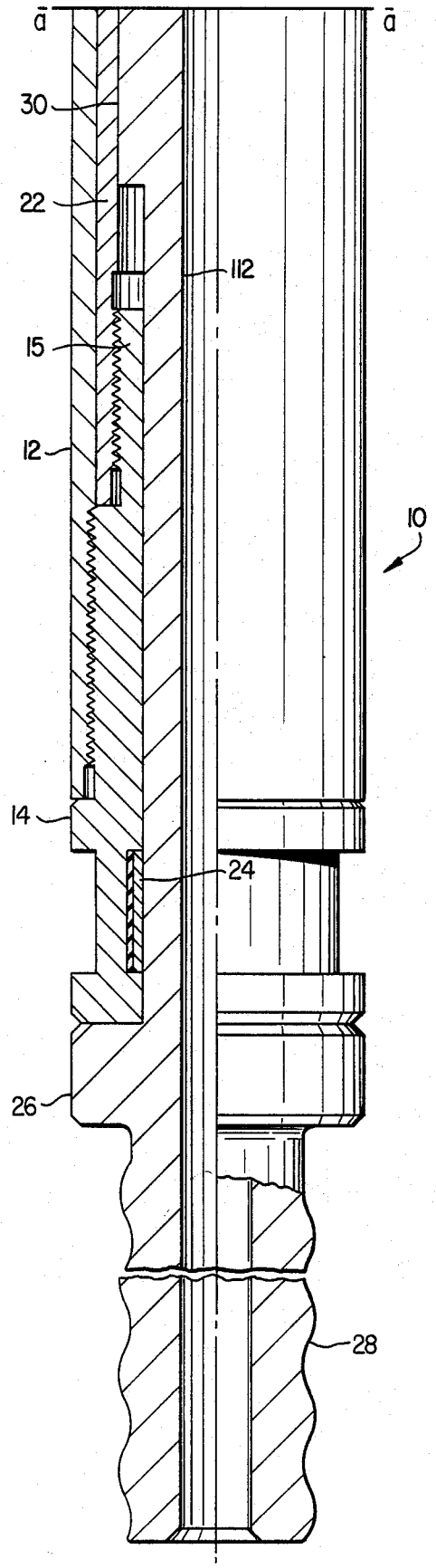
FIGS. 1A through 1F comprise a longitudinal central section view of a preferred embodiment of a hydraulic percussion tool in accordance with the present invention.

In the description which follows like parts are marked throughout the specification and drawing with the same reference numerals, respectively. The drawing figures are not necessarily to scale and certain features of the invention may be shown exaggerated in scale in the interest of clarity and conciseness.

FIGS. 1A through 1F, when viewed end-to-end along matched parting lines a—a, b—b, and so on, comprise a longitudinal partial and full central section view of a elongated hydraulic percussion tool, generally designated by the numeral 10. For convenience only, the tool 10 will be referred to as having a lower end, FIG. 1A, and an upper end, FIG. 1F. By way of example only, one preferred embodiment of a tool in accordance with the present invention has an overall length of approximately 75.0 inches and an outer diameter of approximately 1.50 inches. The length of certain components in the drawing FIGS. 1A through 1F may be exaggerated by elimination of certain sections of the tool wherein no change in the structural features of the components illustrated occurs.

The tool 10 is characterized by an outer cylinder member 12 comprising an elongated cylindrical tube which is internally threaded at its opposite ends and is threadedly secured at its lower end, FIG. 1A, to a lower head member 14. The outer cylinder 12 is threadedly connected at its upper end, FIG. 1E, to an intermediate head member 16. An inner cylinder member 18, FIGS. 1C thru 1E, is disposed within the outer cylinder member 12 and forms with the outer cylinder a unique arrangement of fluid conducting passages to be described in further detail herein. The inner cylinder member 18 may be secured in the outer cylinder member by an interference fit and by a tubular bearing support member 20, FIGS. 1B and 1C, disposed in the lower end of the outer cylinder member 12. The bearing support member 20 is retained in the outer cylinder member 12 by a chuck sleeve 22, FIGS. 1A and 1B, which is threadedly engaged with a reduced diameter portion 15 of the lower head member 14. The lower head member 14 supports a split sleeve bearing member 24, FIG. 1A, for slidably journaling an impact receiving member, generally designated by the numeral 26. The impact receiving member 26 may comprise an integral percussion type bit or, as illustrated, may be characterized by an externally threaded portion 28 at its lower end for coupling the impact receiving member to a bit member or to another impact blow transmitting member, not shown. The impact receiving member 26 includes an annular collar portion 30 which is retained between the lower head member 14 and the bearing support member 20 for limited axial movement to place an impact receiving surface 32, FIG. 1B, in blow receiving engagement with an elongated reciprocable piston-hammer, generally designated by the numeral 34 in FIGS. 1B thru 1D. The bearing support member 20 includes spaced apart split sleeve type bearings 35 and 36, FIG. 1B, which are adapted to slidably support the upper end of the impact receiving member 26 and the lower end of the piston-hammer 34, respectively. As shown in FIG. 1C the bearing support member 18 receives the lower end 19 of the inner cylinder member 20 in an annular recess 21 formed in the upper end of the bearing support member.

Figure 1B:
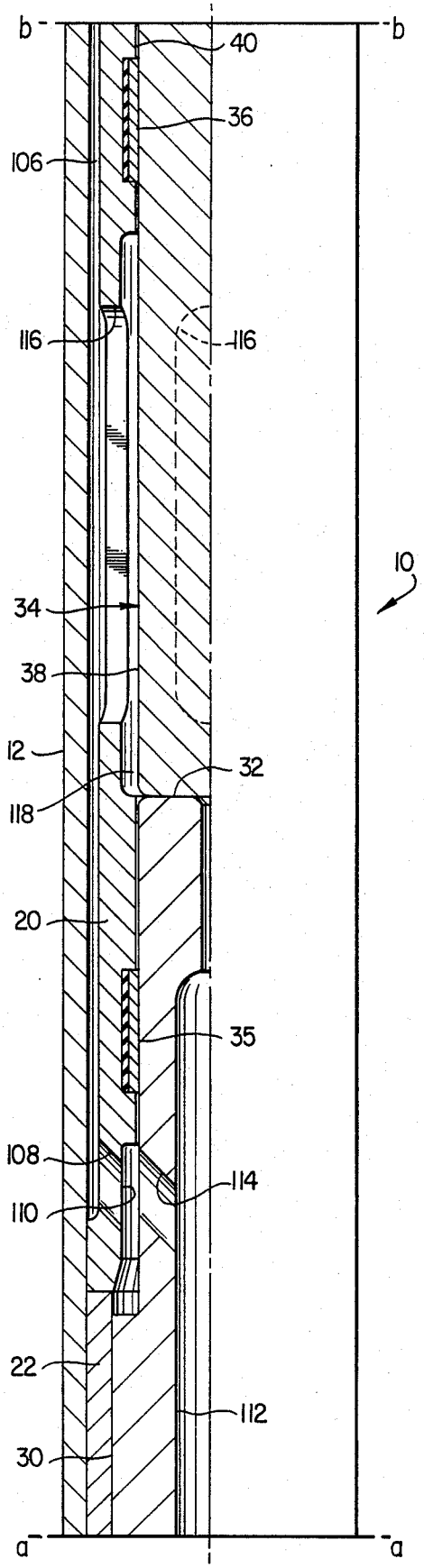
Figure 1C:
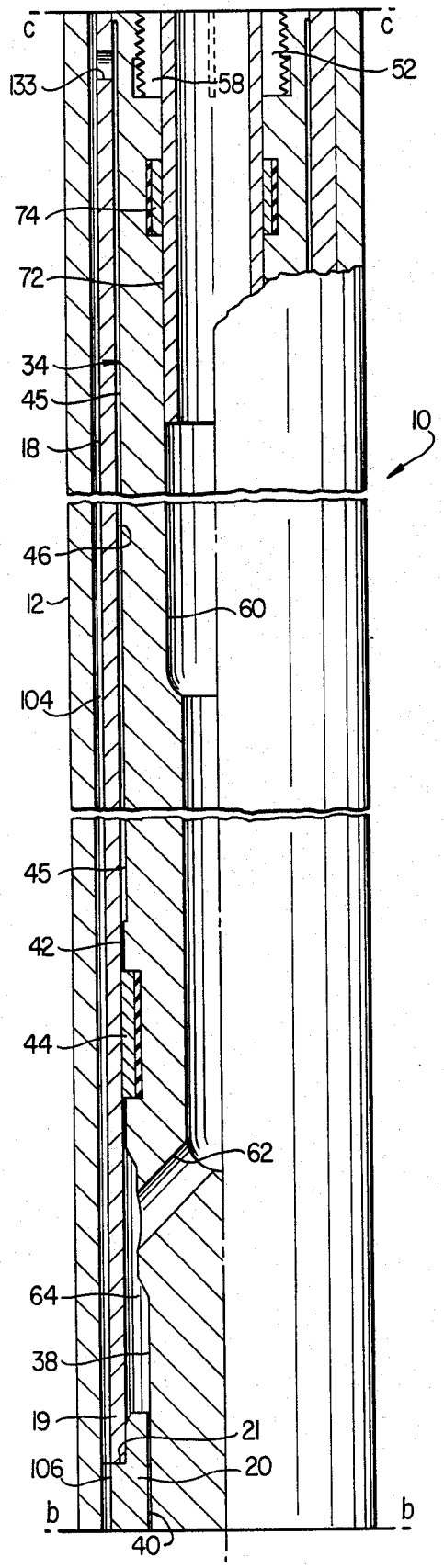
Figure 1D:
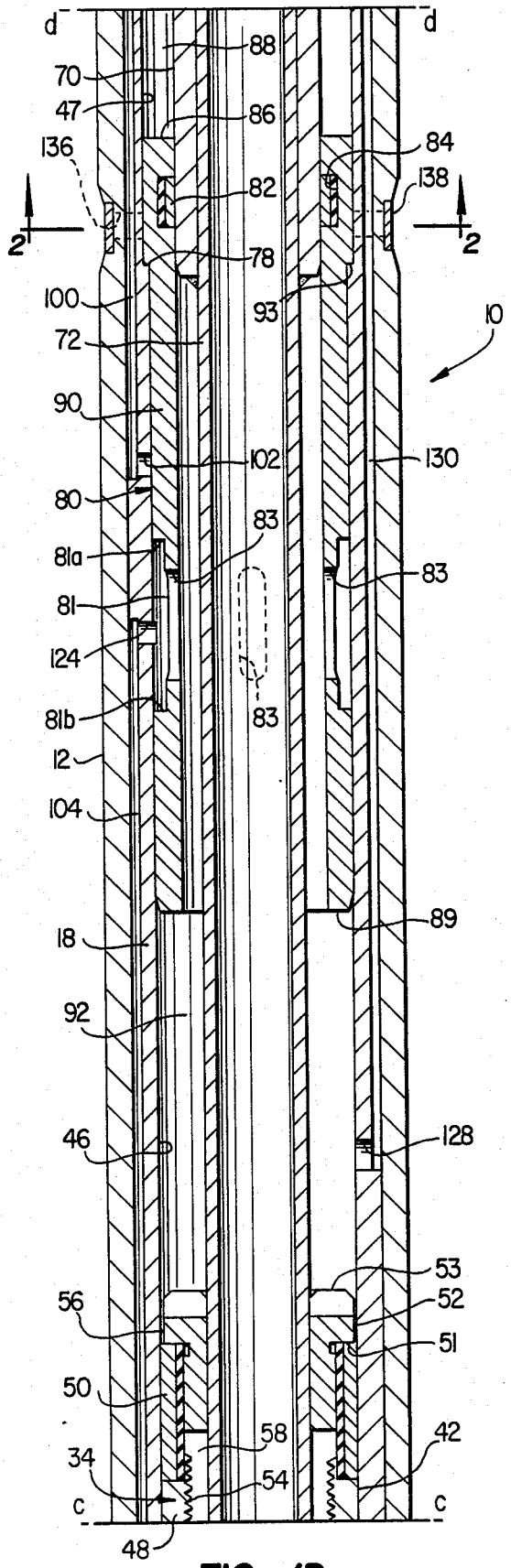
Figure 1E:
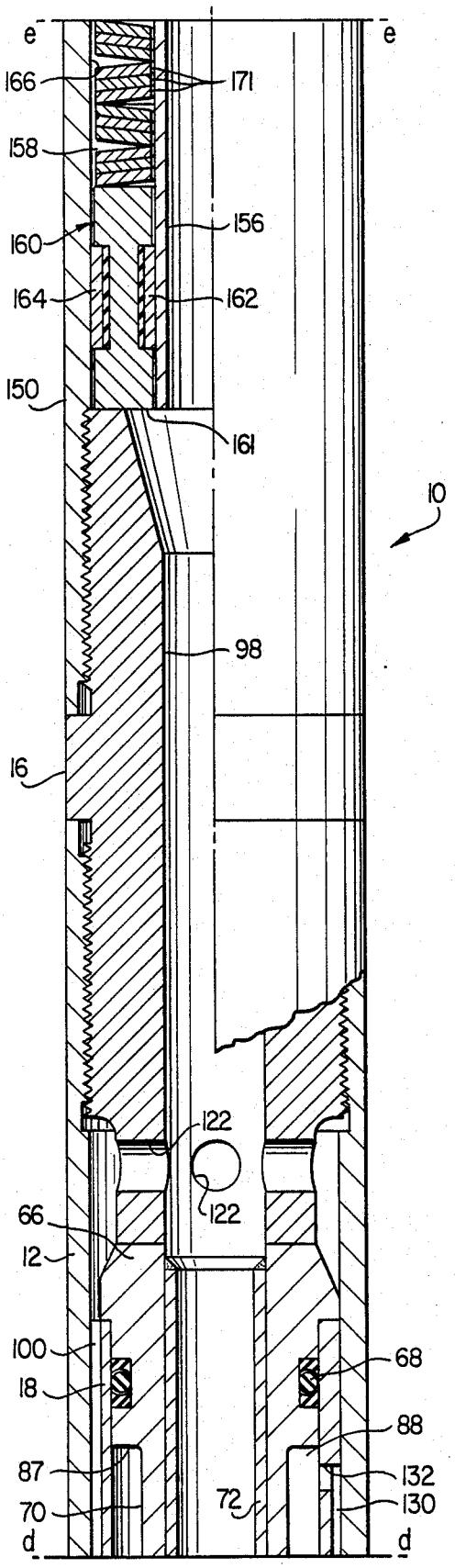

As shown in FIG. 1B, the piston-hammer 34 has an elongated reduced diameter shank portion 38 which is journaled by the bearing 36 and is in close fitting proximity to a bore 40 formed in the bearing support member 20. The piston-hammer 34 also includes an enlarged diameter portion 42, FIGS. 1C and 1D, having a sleeve bearing 44, FIG. 1C, disposed thereon and slidably engaged with the bore 46 of the inner cylinder member 18. The enlarged diameter portion 42 is relieved at 45 away from the bore 46 and terminates at an upper shoulder portion 48, FIG. 1C and 1D. A second hammer support bearing 50 is disposed at the upper end of the enlarged diameter portion 42 and is retained on the piston-hammer 34 by a removable nut 52, FIG. 1D, threadedly engaged with an internally threaded portion 54 at the upper end of the piston-hammer. The nut 52 has a bearing retaining shoulder 56 formed thereon and an axially slotted threaded portion 58 adapted to form an interference type threaded connection between the piston-hammer 34 and the nut 52. The piston-hammer 34 further includes an axially extending passage 60, FIG. 1C, which extends from the upper end of the piston-hammer to the lower end of the enlarged diameter portion 42. Branch passages 62, one shown, open from the passage 60 into an expansible chamber 64 formed in the cylinder 18 between the enlarged diameter portion 42 of the piston-hammer and the upper end of the bearing support member 20.

Referring to FIG. 1E, in particular, the intermediate head or coupling member 16 is engaged with an upper head member 66 for the inner cylinder 18 and retains the head member 66 in sealing engagement with the upper end of the inner cylinder 18 to form a fluid tight seal by a ring type seal assembly 68. The head member 66 includes a reduced diameter tubular extension 70 which is integrally formed with or suitably fixed to an elongated fluid conducting tube 72 extending into the passage 60 in the piston-hammer 34, see FIG. 1C, and in slidable sealing engagement with the piston-hammer by a split sleeve bearing and seal member 74. The bore 46 of the inner cylinder 18 extends toward the upper end of the inner cylinder and terminates at a second and slightly larger bore 47 to form a shoulder 78, FIG. 1D.

Referring to FIG. 1D, an elongated tubular sleeve type fluid distributing valve member 80 is slidably disposed in the bore 46 and in sleeved relationship around the tubular extension 70 of the inner cylinder head member 66. A suitable split sleeve type bearing assembly 82 is disposed in an annular groove 84 formed in the valve member 80 to form support for and a fluid seal between the valve member 80 and the extension 70 of the head member 66. The valve member 80 includes an upper transverse surface 86 which in part defines an annular valve tripping chamber 88 also defined in part by the head member 66 and the inner cylinder 18, see FIG. 1E also. The valve member 80 includes a reduced diameter body portion 90 slidably disposed in close fitting relationship in the bore 46 and defining a shoulder 93 opposing the annular shoulder 78.

Figure 2:
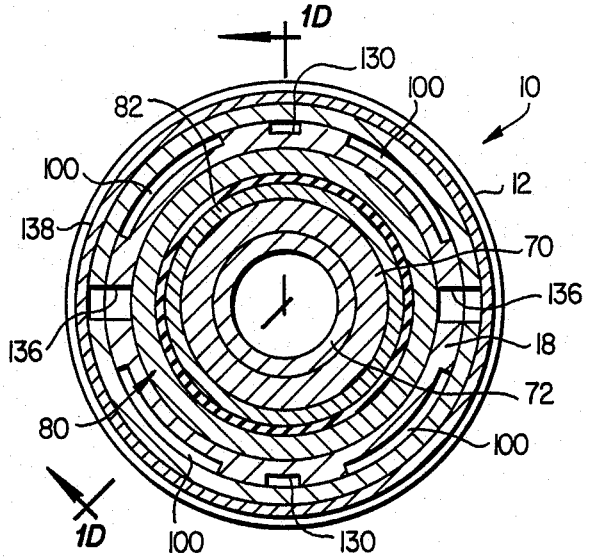
FIG. 2 is a section view taken along the line 2—2 of FIG. 1D.

A second expansible chamber 92, FIG. 1D, is formed between the upper end of the piston-hammer 34, the valve member 80 and the head member 66. The effective cross sectional area of the piston-hammer 34 in a plane normal to the central longitudinal axis of tool 10 exposed to the chamber 92 is greater than the effective cross sectional area of the piston-hammer exposed to the chamber 64. Accordingly, if fluid pressures are equal in the chambers 64 and 92 the piston-hammer 34 will be biased in the upward direction or toward the rearwardly disposed valve member 80. As shown in FIG. 1D, the valve member 80 includes an annular groove 81 and radially extending elongated slot-like passages 83 which form transfer passages between the chamber 92 and suitable fluid conducting passages formed between the inner and outer cylinder members 18 and 12. High pressure working fluid such as water or "drilling mud" is introduced to the tool 10 through a passage 98, FIG. 1E, formed in the intermediate head member 16 which is in communication with the fluid conducting tube 72 and the passage 60 in the piston-hammer 34. A plurality of circumferentially spaced passages 100, FIGS. 1D and FIG. 2, are defined by longitudinal grooves formed in the outer surface of the inner cylinder member 18 and the bore of the outer cylinder 12. The full section view of FIGS. 1D and 1E are taken along line 1D—1D of FIG. 2 to show the longitudinal extent of certain passages formed between the cylinder members 12 and 18. The passages 100 extend to circumferentially spaced slots 102, one shown in FIG. 1D, which open into the chamber 92 depending on the position of the valve member 80.

A second set of longitudinally extending passages 104, one shown in FIG. 1D, are in like manner formed between the inner and outer cylinder members 18 and 12 and defined in part by elongated grooves extending to the lower end of the inner cylinder member 18 and are in communication with passages 106, one shown in FIG. 1B, formed between the outer cylinder member 12 and the bearing support member 20. The passages 106 are in communication with transfer passages 108, one shown, formed in the bearing support member 20 and an annular chamber 110 formed between the bearing support member 20 and the upper end of the impact receiving member 28. The chamber 110 is in communication with a longitudinally extending passage 112 formed in the impact receiving member 26 by way of circumferentially spaced transfer passages 114. Additional transfer passages 116 are formed in the bearing support member 20 and open into a chamber 118 which is in communication with the fluid conducting passage 112 when the piston-hammer 34 is out of contact with the impact receiving member 26.

Referring again to FIG. 1E, the passages 100 are adapted to receive high pressure fluid from the passage 98 through transversely extending passages 122 in the intermediate head member 16 for conducting high pressure fluid to the chamber 92 when the valve member 80 is disposed in a position such that its upper end face 86, FIG. 1D, is moved toward the transverse surface 87, FIG. 1E, formed on the inner cylinder head member 66. When the groove 81 uncovers the slots 102, FIG. 1D, high pressure working fluid may be communicated directly to the chamber 92 to urge the piston-hammer 34 to deliver an impact blow to the member 26. The piston-hammer 34 is continually biased to move toward the valve member 80 by high pressure working fluid supplied to the chamber 64 through the passage 98, the tube 72 and the passages 60 and 62.

Referring further to FIG. 1D the passages 104 are also operable to be in fluid flow communication with the chamber 92 by way of circumferentially spaced slots 124, one shown, which open into the transfer passage formed by the groove 81 for communicating the chamber 92 with the passage 112 in the impact receiving member by way of the ports 83, the groove 81 and the passages 104, 106 and the passages 108, 110 and 114 for venting pressure fluid from the chamber 92 when the valve member 80 is in the position shown in FIG. 1D. The chamber 92 is also operable to be in communication with the chamber 88, FIG. 1D, by way of ports 128, one or more elongated passages 130 formed by grooves in the inner cylinder member 18, see FIG. 2 also, and ports 132, FIG. 1E, which open into the chamber 88 from the passages 130. When the piston-hammer 34 has moved on an impact delivering stroke to a point where the expansible chamber 92 is placed in communication with the ports 128 the chamber 92 and chamber 88 are in communication with each other and at the pressure of the working fluid in the chamber 92.

Referring still further to FIG. 1D and FIG. 2, when the valve member 80 is moved from the position shown to a position toward the transverse surface 87, an annular chamber is formed between the bore 47 and the body portion 90 of the valve member 80. Since pressure fluid may leak into this chamber due to the working clearances, however small, between the valve member and the bores 46 and 47 this fluid is vented from the chamber so formed through spaced apart radially extending ports 136. The ports 136 are closed by a check valve formed by a resilient split flat ring member 138 which is disposed in a groove 140 formed in the outer cylinder 12. Accordingly, fluid leaking into the annular chamber formed between the bore 47 and the valve 80 may be vented through the ports 136 by slightly expanding the ring 138 to relieve fluid which may be trapped in this chamber and which would otherwise prevent full linear movement of the valve member toward the position shown in FIG. 1D. The impact of the valve member 80 with the shoulder 78 is cushioned, however, by a small amount of fluid trapped when the surface 93 moves past the ports 136 toward the shoulder 78.

Figure 1F:
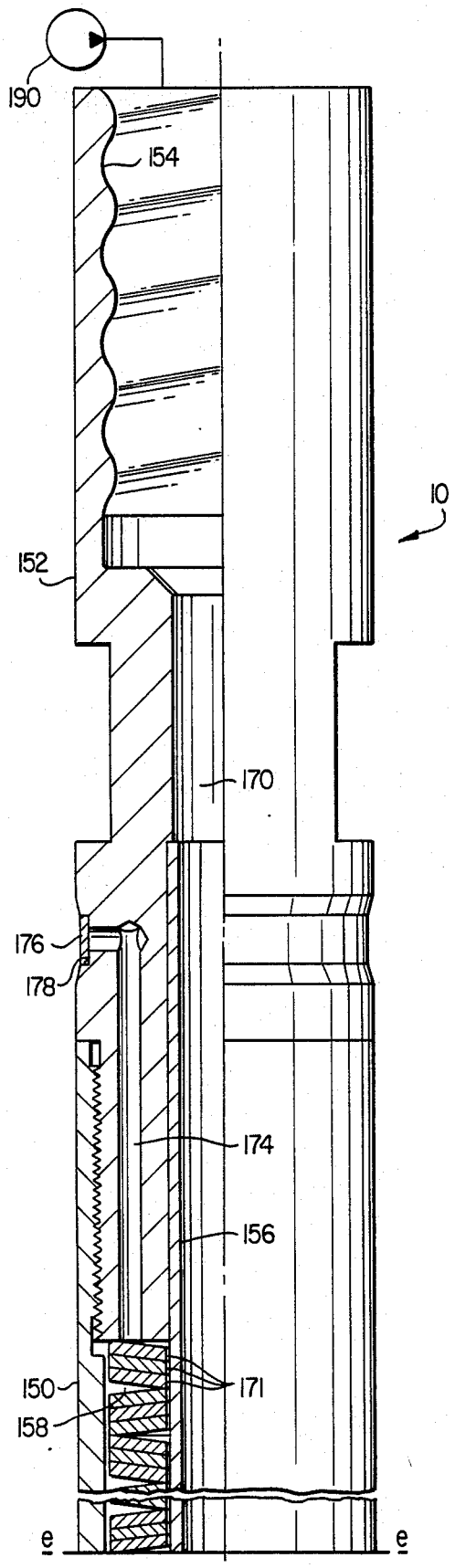

Referring now to FIGS. 1E and 1F, the tool 10 is further characterized by a hydraulic accumulator formed by an upper outer cylinder member 150 which is threadedly connected to the upper end of the intermediate head 16 and to an upper head member 152. The upper head member 152 is suitably adapted to have an internally threaded portion 154, for example, for coupling the tool 10 to a drill stem, not shown. In certain applications of the tool 10 a reduction in hydraulic fluid flow losses should be accommodated by providing a hydraulic fluid accumulator characterized by an elongated tube member 156 extending from the upper head 152 into a bore formed by the upper outer cylinder 150 and defining an annular space 158. An annular piston 160, FIG. 1E, is disposed in the space 158 and includes inner and outer annular seal/bearing members 162 and 164 which slidably engage the tube 156 and the bore wall 166 of the cylinder 150, respectively.

A central, high pressure fluid conducting passage 170 is formed in the upper head member 152 and by the tube 156 for conducting high pressure working fluid to the passage 98. A transverse end face 161, FIG. 1E, is formed on the piston 160 and is in constant communication with the passage 98 whereby the piston 160 is responsive to cyclic variations in pressure in the passage to compress resilient means comprising a series of axially stacked conical washer or belleville type springs 171. The springs 171 have a relatively high force-deflection ratio and are considered suitable for the operating characteristics of the tool 10 with a very long fatigue life as compared with utilizing other types of mechanical springs as means for biasing the accumulator piston 160. The chamber 158 is suitably vented to the exterior of the tool 10 through a passage 174, FIG. 1F, and an annular resilient split ring type check valve 176 disposed in a circumferential groove 178 formed in the upper head member 152.

The tool 10 provides several advantages for a hydraulic percussion tool which is adapted to be operated in-the-hole. By arranging the piston-hammer 34 and the pressure fluid distributing valve 80 axially spaced apart, the diameter of the piston-hammer may be maximized for a given outer diameter of the outer cylinder 12 and thus the hammer mass maximized as desired for heavy impact blow applications. The tubular sleeve type distributing valve 80 provides for efficient and low pressure loss flow of fluid into and out of the chamber 92. The axially in-line hydraulic accumulator provided by the annular piston 160 and the resilient spring arrangement provided by the conical washer type springs 171 is a convenient arrangement which also does not hinder the limits placed on the outer envelope diameter of the tool 10. Still further, the unique arrangement of the inner cylinder 18 with respect to the outer cylinder 12 and the formation of the fluid flow passages for communicating pressure fluid to the chamber 92, from the chamber 92, and to the impact receiving member 26 for using spent working fluid as drill cuttings evacuation fluid is also particularly advantageous.

The general operation of the tool 10 will now be described in conjunction with FIGS. 1B through 1E, in particular. Pressure fluid is supplied to the passage 98 from a suitable source such as a hydraulic pump 190, FIG. 1F, and is conducted to the chamber 64 by way of the tube 72 and passages 60, 62 to bias the piston-hammer 34 upwardly or toward the valve 80. When the chamber 92 is vented through the transfer passages provided by the ports 83 and the groove 81 and the passages 104, the chamber 88 and the chamber 92 are at equal pressures and the piston-hammer 34 will move to engage the lower end face 89 of the valve 80 to urge the valve toward the shoulder or surface 87. Just prior to engagement of the valve member 80 the piston-hammer 34 will move to a position which places the chamber 88 in communication with the passages 104 by way of the port 128, the annular chamber around the piston-hammer formed by the bore 46 and relieved diameter portion 45 and one or more ports 133, FIG. 1C, so that fluid can be vented from chamber 88. The length of the groove 81 is delimited by control edges 81*a* and 81*b* and this length is determined to be such that as the control edge 81*b* closes off communication of the groove 81 with the ports 124 the control edge 81*b* passes the edge of ports 102 to place high pressure working fluid in communication with the chamber 92 through the transfer passages 83. As the pressure of working fluid in the chamber 92 rises to the working pressure the piston-hammer 34 will be driven on an impact blow delivering stroke toward the impact receiving member 26.

The valve 80 will remain in the upward position to which it was biased or moved by the piston-hammer 34 until the piston-hammer passes the port 128 and places it in communication with an the chamber 92 during an impact blow delivering stroke. When the port 128 is uncovered pressure fluid in chamber 92 is transferred to chamber 88 through passage 130 to act on the end face 86 of the valve member 80 to rapidly trip or shift the valve member toward the position illustrated in FIG. 1D cutting off communication of high pressure working fluid from the passages 100 to the chamber 92 and placing the chamber 92 in communication with the passages 104 through the transfer passages 83 and the groove 81. The position of the hammer-piston 34 and the valve member 80 shown in the drawing are those at which the piston-hammer has just impacted the member 26 and the motion of the valve member 80 toward the piston-hammer is arrested by engagement of the shoulder 93 with the shoulder 78. As mentioned above, actual engagement of these two surfaces is minimized or cushioned by a small amount of hydraulic fluid trapped in the chamber formed between the bore 47 and the body portion 90 of the valve member 80 as the shoulder 93 passes the relief ports 136. In other words a dashpot arrangement is provided by the chamber formed between the bore 47, the body 90 and the opposed shoulders 78 and 93.

When the chamber 92 has been vented to the passages 104 as shown by the position of the piston-hammer 34 and the valve 80 in FIG. 1D, the pressure of working fluid in chamber 64 will urge the piston-hammer 34 to move upwardly until a surface 53 on the nut 52 engages the surface 89 of the valve member 80 and returns the valve member to the starting position of delivering pressure fluid to the chamber 92. Thus, the valve member 80 is shifted in one direction by pressure fluid acting against the face 86 and is shifted in the other direction by engagement of the piston-hammer 34 with the valve member. The nut 52 may be modified or replaced by a similar nut having an axial length between the surface 53 and the bearing retaining shoulder 51, FIG. 1D, which is either greater than or less than that of the nut 52 shown in the drawing figures. In this way the stroke length of the piston-hammer 34 may be varied in accordance with the length of the easily removable and replaceable bearing retainer nut 52.

The tool 10 may be constructed of conventional engineering metals and other materials which are compatible with use of water or low density drilling muds as the working fluids. For example, the combination bearing and seals 24, 35, 36, 44, 50, 74, 82, 162 and 164 may be formed of glass filled Teflon or similar fluorocarbon plastic material.

Although a preferred embodiment of the present invention has been described in detail herein those skilled in the art will recognize that various substitutions and modifications may be made to the hydraulic percussion tool described without departing from the scope and spirit of the invention as recited in the appended claims.

What we claim is:

1. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member toward a first position;

means on said piston-hammer for engaging said valve member for moving said valve member toward a second position;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder for engagement of said piston-hammer with said valve member to move said valve member toward said second position to permit communication of pressure fluid to said second chamber to urge said piston-hammer on an impact blow delivering stroke; and means forming third passage means for communicating pressure fluid between said second chamber and said valve trip chamber for moving said valve member from said second position urged by said piston-hammer to said first position to place said second passage means in communication with said second chamber.

2. A hydraulic percussion tool for delivering repeated impact blows to an impact blow receiving member comprising:

an elongated cylinder forming a generally cylindrical bore;

a piston-hammer including a shank portion having an impact blow delivering surface thereon, said piston-hammer defining with said cylinder first and second expansible fluid chambers;

first passage means in said cylinder and adapted to be placed in communication with said second chamber;

second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder; and hydraulic accumulator means connected to one end of said cylinder and including an elongated tubular housing part, an inner tube member defining a fluid passage in communication with said supply passage means for conducting pressure fluid thereto and an annular piston slidably disposed in said tubular housing part around said inner tube member, and resilient spring means for biasing said piston in one direction, said piston having a surface exposed to a pressure fluid passage in communication with at least one of said supply passage means and said first passage means.

3. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

said valve member including transfer passage means formed therein for communicating said second chamber with said first passage means and said second pasage means in accordance with the position of said valve member in said cylinder;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke; and means forming third passage means for communicating pressure fluid between said second chamber and said valve trip chamber for moving said valve member from a first position urged by said piston-hammer to a second position to place said second passage means in communication with said second chamber.

4. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke;

means forming third passage means for communicating pressure fluid between said second chamber and said valve trip chamber for moving said valve member from a first position urged by said piston-hammer to a second position to place said second passage means in communication with said second chamber;

a transverse surface formed in said cylinder, a transverse surface formed on said valve member and a valve cushion chamber formable in said cylinder between said transverse surfaces for limiting the movement of said valve member toward said piston-hammer when pressure fluid is communicated to said valve trip chamber.

5. The tool set forth in claim 4 including:

passage means in communication with said cushion chamber for conducting fluid out of said cushion chamber.

6. The tool set forth in claim 5 including:

valve means in said passage means to prevent flow of fluid from the exterior of said tool into said cushion chamber, said valve means comprising a resilient cylindrical ring closing said passage means and responsive to fluid pressure in said passage means to vent fluid from said cushion chamber.

7. A hydraulic percussion tool for delivering repeated impact blows to an impact blow receiving member comprising:

an elongated cylinder forming a generally cylindrical bore;

a piston-hammer including a body including a reduced diameter shank portion having an impact blow delivering surface thereon and defining with said cylinder a first expansible fluid chamber and a removable head portion of said piston-hammer threadedly connected to said body and interchangeable with a selected head portion having a length different than the length of said removable head portion for determining the effective stroke length of said piston-hammer;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke; and means forming third passage means for communicating pressure fluid between said second chamber and said valve trip chamber for moving said valve member from a first position urged by said piston-hammer to a second position to place said second passage means in communication with said second chamber.

8. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

said cylinder including an elongated outer cylinder member connected at one end to means forming a cylinder head, and an elongated inner cylinder member disposed in said outer cylinder member, said inner cylinder member and said outer cylinder member forming therebetween at least part of said first passage means and said second passage means;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke; and means forming third passage means for communicating pressure fluid between said second chamber and said valve trip chamber for moving said valve member from a first position urged by said piston-hammer to a second position to place said second passage means in communication with said second chamber.

9. The tool set forth in claim 8 wherein:

said third passage means is formed between said inner cylinder member and said outer cylinder member for conducting pressure fluid from said second chamber to said valve trip chamber.

10. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke;

means forming third passage means for communicating pressure fluid between said second chamber and said valve trip chamber for moving said valve member from a first position urged by said piston-hammer to a second position to place said second passage means in communication with said second chamber; and a bearing support member disposed in said cylinder and including bearing means for at least partially supporting said piston-hammer, said bearing support member including passage means therein in communication with said second passage means for conducting working fluid to said impact receiving member for use as drillhole flushing fluid.

11. The tool set forth in claim 10 including:

a cylinder head member removably connected to said cylinder for retaining said impact receiving member in a working position to be impacted by said piston-hammer and adapted to retain said bearing support member in said cylinder.

12. A hydraulic percussion tool for delivering repeated impact blows to an impact blow receiving member comprising:

an elongated cylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke;

means forming third passage means for communicating pressure fluid between said second chamber and said valve trip chamber for moving said valve member from a first position urged by said piston-hammer to a second position to place said second passage means in communication with said second chamber; and hydraulic accumulator means connected to one end of said cylinder and including an elongated tubular housing part, a piston slidably disposed in said housing part and resilient spring means for biasing said piston in one direction, said piston having a surface exposed to a pressure fluid passage in communication with at least one of said first passage means and said supply passage means.

13. The tool set forth in claim 12 wherein:

said cylinder includes an upper head member forming an intermediate member between said accumulator housing part and said cylinder.

14. The tool set forth in claim 12 wherein:

said accumulator housing part includes means adapted to form a connection for said tool to a drill stem or the like.

15. A hydraulic percussion tool for delivering repeated impact blows to an impact blow receiving member comprising:

an elongated bylinder forming a generally cylindrical bore;

a piston-hammer including a reduced diameter shank portion having an impact blow delivering surface thereon and defining with said cylinder a first expansible fluid chamber;

means closing an end of said cylinder opposite said first chamber, and a tubular fluid distributing valve member disposed in said cylinder between said piston-hammer and said means closing said cylinder, said valve member forming with said means closing said cylinder a valve trip chamber for receiving pressure fluid to bias said valve member in one direction;

a second expansible chamber formed in said cylinder between said piston-hammer and said means closing said end of said cylinder;

means forming first passage means in said cylinder and operable to be placed in fluid flow communication with said second chamber by said valve member;

means forming second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder and for engagement with said valve member to move said valve member to a position to permit communication of pressure fluid to said second chamber to urge said piston-hammer on an impact blow delivering stroke;

means forming third passage means for communicating pressure fluid between said second chamber and said valve trip chamber for moving said valve member from a first position urged by said piston-hammer to a second position to place said second passage means in communication with said second chamber; and fourth passage means formed in part between said piston-hammer and said cylinder and operable during movement of said valve member by said piston-hammer to conduct fluid from said third passage means to said second passage means.

16. A hydraulic percussion tool for delivering repeated impact blows to an impact blow receiving member comprising:

an elongated cylinder forming a generally cylindrical bore;

a piston-hammer including a shank portion having an impact blow delivering surface thereon, said piston-hammer defining with said cylinder first and second expansible fluid chambers;

first passage means in said cylinder and adapted to be placed in communication with said second chamber;

second passage means in said cylinder and adapted to be placed in communication with said second chamber for conducting pressure fluid from said second chamber to permit reciprocation of said piston-hammer;

supply passage means for supplying pressure fluid to said first chamber for urging said piston-hammer in one direction in said cylinder; and hydraulic accumulator means connected to one end of said cylinder and including an elongated tubular housing part, a piston slidably disposed is said housing part, and resilient spring means comprising a plurality of conical spring washers disposed in an annular chamber formed in said housing part for biasing said piston in one direction, said piston having a surface exposed to a pressure fluid passage in communication with at least one of said supply passage means and said first passage means.

17. The tool set forth in claim 16 wherein:

said cylinder includes an upper head member forming an intermediate member between said housing part and said cylinder, said housing part including means adapted to form a connection for said tool to a drill stem or the like.

18. A hydraulic percussion tool for delivering repeated impact blows to an impact blow receiving member comprising;

elongated cylinder means forming a generally cylindrical bore;

a piston-hammer including a portion having an impact blow delivering surface thereon and defining with said cylinder means first and second expansible fluid chambers;

a fluid distributing valve disposed in said cylinder means;

said cylinder means including an elongated outer cylinder member connected at one end to means forming a cylinder head and an elongated inner cylinder member disposed in said outer cylinder member, said inner cylinder member and said outer cylinder member forming therebetween first and second passage means;

said first passage means being adapted to be placed in fluid flow communication with said second chamber by said distributing valve and said second passage means being adapted to be placed in communication with said second chamber for conducting pressure fluid from said second chamber to permit reciprocation of said piston-hammer;

means for supplying pressure fluid to said first chamber for urging said piston-hammer in one direction in said bore;

third passage means formed by said inner and outer cylinder members for communicating said second chamber with said valve member for moving said valve member from a first position under the urging of pressure fluid to a second position to place one of said first and second passage means in communication with said second chamber; and a bearing support member disposed in said outer cylinder member and including bearing means for at least partially supporting said piston-hammer, said bearing support member including passage means therein in communication with said second passage means for conducting working fluid to said impact receiving member for use as a flushing fluid.

* * * * *